US010583974B2

(12) United States Patent
Hokanson et al.

(10) Patent No.: US 10,583,974 B2
(45) Date of Patent: Mar. 10, 2020

(54) PACKAGED TISSUE PRODUCTS

(71) Applicant: Kimberly-Clark Worldwide, Inc., Neenah, WI (US)

(72) Inventors: Brandon Mark Hokanson, Sheboygan Falls, WI (US); Jason John Schumaker, Hortonville, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 49 days.

(21) Appl. No.: 16/070,548

(22) PCT Filed: Jan. 31, 2018

(86) PCT No.: PCT/US2018/016093
§ 371 (c)(1),
(2) Date: Jul. 17, 2018

(87) PCT Pub. No.: WO2019/152000
PCT Pub. Date: Aug. 8, 2019

(65) Prior Publication Data
US 2019/0375568 A1 Dec. 12, 2019

(51) Int. Cl.
*B65D 77/26* (2006.01)
*B65D 85/07* (2017.01)
*B65D 77/04* (2006.01)

(52) U.S. Cl.
CPC ..... *B65D 77/26* (2013.01); *B65D 77/0406* (2013.01); *B65D 85/07* (2018.01)

(58) Field of Classification Search
CPC .... B65D 77/26; B65D 85/07; B65D 77/0406; B65D 85/672; B65D 71/10; B65D 85/62
USPC ..... 206/391, 497, 581, 393–395, 389, 397, 206/812, 225, 703, 705, 410; 220/557, 220/553
See application file for complete search history.

(56) References Cited

U.S. PATENT DOCUMENTS

| | | | |
|---|---|---|---|
| 2,573,309 | A | 10/1951 | Chipkevich |
| 3,239,097 | A | 3/1966 | Bates |
| 3,369,699 | A | 2/1968 | Enloe |
| 4,558,785 | A | 12/1985 | Gordon |
| 4,863,064 | A | 9/1989 | Dailey |

(Continued)

FOREIGN PATENT DOCUMENTS

| | | | |
|---|---|---|---|
| CN | 2639224 | Y | 9/2004 |
| CN | 2737698 | Y | 11/2005 |

(Continued)

*Primary Examiner* — Rafael A Ortiz
(74) *Attorney, Agent, or Firm* — Kimberly-Clark Worldwide, Inc.

(57) ABSTRACT

A unitary package including a rolled tissue product and a packaged tissue product overwrapped with a packaging film. The packaged tissue product may be disposed in a folded over portion of a divider and co-packed with first and second rolled tissue products, which differ in at least one regard, to increase the stability of the package. The rolled tissue products preferably comprise a plurality of rolled towel products having a first height and a plurality of rolled bath tissue products having a second height, where the first height is greater than the second height. The divider, packaged tissue product and first and second rolled tissue products are generally packaged together to form a cubic package.

16 Claims, 4 Drawing Sheets

(56) References Cited

U.S. PATENT DOCUMENTS

| | | | | |
|---|---|---|---|---|
| 5,685,428 | A | 11/1997 | Herbers | |
| 6,523,690 | B1 | 2/2003 | Buck | |
| 7,237,671 | B2 | 7/2007 | Chambers | |
| 7,621,397 | B2 | 11/2009 | Boudrie | |
| 7,661,552 | B2 * | 2/2010 | Baum | A47K 10/421 221/37 |
| 7,721,887 | B2 | 5/2010 | Hancock-Cooke | |
| D636,273 | S | 4/2011 | Ver Kuilen | |
| 8,205,748 | B2 | 6/2012 | Long | |
| 9,708,085 | B2 * | 7/2017 | Moore | B65B 27/125 |
| 2004/0200752 | A1 * | 10/2004 | Poli | B65D 71/08 206/497 |
| 2005/0011906 | A1 | 1/2005 | Buck | |
| 2007/0141208 | A1 | 6/2007 | Nukuto | |
| 2015/0367981 | A1 | 12/2015 | Moore | |
| 2016/0067120 | A1 * | 3/2016 | Meeks | B65B 25/145 53/443 |
| 2017/0057733 | A1 * | 3/2017 | Wentz | B65D 71/063 |

FOREIGN PATENT DOCUMENTS

| | | | |
|---|---|---|---|
| CN | 2873170 | Y | 2/2007 |
| CN | 201224560 | Y | 4/2009 |
| CN | 201280274 | Y | 7/2009 |
| CN | 202207210 | U | 5/2012 |
| DE | 202015100065 | U1 | 3/2015 |
| KR | 20040006732 | A | 1/2004 |
| KR | 100767381 | B1 | 10/2007 |
| KR | 20110126910 | A | 11/2011 |
| WO | WO9733806 | A1 | 9/1997 |
| WO | WO15130305 | A1 | 9/2015 |
| WO | WO-2015130305 | A1 * | 9/2015 |

* cited by examiner

PACKAGED TISSUE PRODUCTS

BACKGROUND OF THE INVENTION

Rolled tissue products, such as toilet tissue, paper towels, and the like, are typically packaged and marketed in multi-packs, with six or more rolled products packaged together in a single package. Packaging typically consists of an outer covering composed of a plastic film in the form of a bag housing a plurality of rolls. Typically the tissue rolls, having a cylindrical shape, are arranged side-by-side, in lateral contact and with their axes parallel, to form a called layer. A layer can comprise a single row of rolls or two or more rows of rolls located one behind the next. A single layer, for example made up by two rows each comprising 5 rolls, can be encased into a plastic material sheet to form a package containing 10 rolls in total. Another kind of known package consists of two or more layers of rolls placed one on the top of the other, forming a so called "bundle" which is then wrapped.

Unlike rolled tissue products, sheets of tissue product are typically stacked and placed within a semi-rigid package, such as a container or carton, for shipping, storage, sale, and dispensing. In certain instances multi-packages of tissue sheet product may be bundled together and overwrapped with a film to form a unitary package.

In an increasingly demanding and competitive retail environment, there is a need for unique package and merchandising solutions critical to delivering on key customer desires, leveraging consumer insights, and delivering on the overall objectives of a business, while also delivering improved environmental sustainability. More particularly there remains a need in the art for co-packaged goods and more specifically co-packaged wet and dry tissue products.

SUMMARY OF THE INVENTION

The present invention provides a unique packaging, distribution, and merchandising solution that supports new business ventures with retailers and customers. More particularly, the present invention relates to improved configurations for packaging, shipping and displaying rolled and stacked tissue products. The improved packaging reduces the time necessary for shipping and handling and also reduces the amount of packaging materials used, thus reducing the cost to put a product on a retail shelf. For example, in certain embodiments the present invention provides a unitary package for tissue products and more preferably a combination of rolled and stacked tissue products and still more preferably a combination of dry rolled tissue product and packaged wet tissue products. Accordingly, in one embodiment the present invention provides a package of tissue products comprising a divider, a packaged tissue product, a plurality of first rolled tissue products and a plurality of second rolled tissue products wherein the first and second rolled tissue products are different in at least one physical attribute and a packaging film covering at least a portion of the divider and at least a portion of the first and second tissue products.

In other embodiments the present invention provides a unitary package of tissue products comprising a folded paperboard divider dividing the package into front and back halves, a packaged tissue product and a first plurality of rolled tissue products disposed on the front half and a second plurality of tissue products disposed on the second half, and a packaging film at least partially surrounding the first and second plurality of tissue products.

In still other embodiments the present invention provides a unitary package of tissue products comprising a divider comprising a substantially vertical wall panel, a folded over portion defining a cavity extending from the wall panel, a first product receiving void disposed immediately below the folded over portion, and a second product receiving void disposed on the opposite side of the wall panel from the first product receiving void. In certain embodiments the cavity may have a height (h1) that is approximately equal to the height of the packaged tissue product to be retained in the cavity, first product receiving void may have a height (h2) that is approximately equal to the height of the array of tissue products to be disposed therein and the second product receiving void may have a height (h3) that is approximately equal to the height of the array of tissue products to be disposed therein. In a certain preferred embodiment the packaged tissue product to be retained in the cavity is the shortest of packaged tissue products such that h1 is less than h2 and h3. In a particularly preferred embodiment the sum of h1 and h2 are approximately equal to h3.

In other embodiments the present invention provides a package of tissue products comprising a z-shaped divider having a substantially vertical wall panel and a folded over portion defining a cavity extending therefrom, a packaged tissue product disposed in the cavity, a first rolled tissue product disposed below the folded over portion on a first side of the vertical wall panel and a second rolled tissue product disposed on the opposite side of the vertical wall panel.

In yet other embodiments the present invention provides a package of tissue products comprising a divider having a substantially vertical wall panel dividing the package into a first side and an opposite second side, and a folded over portion defining a cavity extending therefrom, a packaged tissue product disposed in the cavity, a first rolled tissue product disposed on the first side and below the folded over portion and a second rolled tissue product disposed on the second side.

In other embodiments the present invention provides a package of tissue products comprising a z-shaped divider having a substantially vertical wall panel and a folded over portion defining a cavity extending therefrom, a packaged tissue product disposed in the cavity, the first packaged tissue product having a first height, a first array of rolled tissue products having a second height and a second array of rolled tissue products having a third height, wherein the sum of the first and second heights is approximately equal to the third height.

In still other embodiments the present invention provides a blank foldable to package a first, second and third product, the blank comprising a first panel, a second panel, a third panel, a fourth panel, a fifth panel and optionally a sixth panel, each of the panels being substantially rectangular and separated from one another by fold lines, wherein the length (L1) of the second panel is substantially equal to the height of the tallest product to be packaged and the length (L2) of the fourth panel is substantially equal to the height of the shortest product to be packaged.

DETAILED DESCRIPTION OF PARTICULAR EMBODIMENTS

Various embodiments of a package of tissue products (hereinafter also referred to simply as a "package") according to the present invention are described in detail with reference to the drawings. As used herein the term "width" generally refers to the longest horizontal dimension of a structure, the term "height" generally refers to the vertical dimension of a structure. The package generally comprises a collection of product items that are to be packaged as a single unit. Generally the package comprises at least two different products. For example, in one embodiment one product is a rolled tissue product and the other product is a stacked tissue product disposed in a carton or dispenser. In a particularly preferred embodiment the package comprises at least three different products, such as a first rolled tissue product having a first height, a second rolled tissue product having a second height, where the second height is greater than the first height, and a stacked tissue product disposed in a carton or dispenser. Preferably the products are packaged together and separated from one another, at least partially, by a folded divider and overwrapped with a film to create a unitary package of products.

Figure 1:
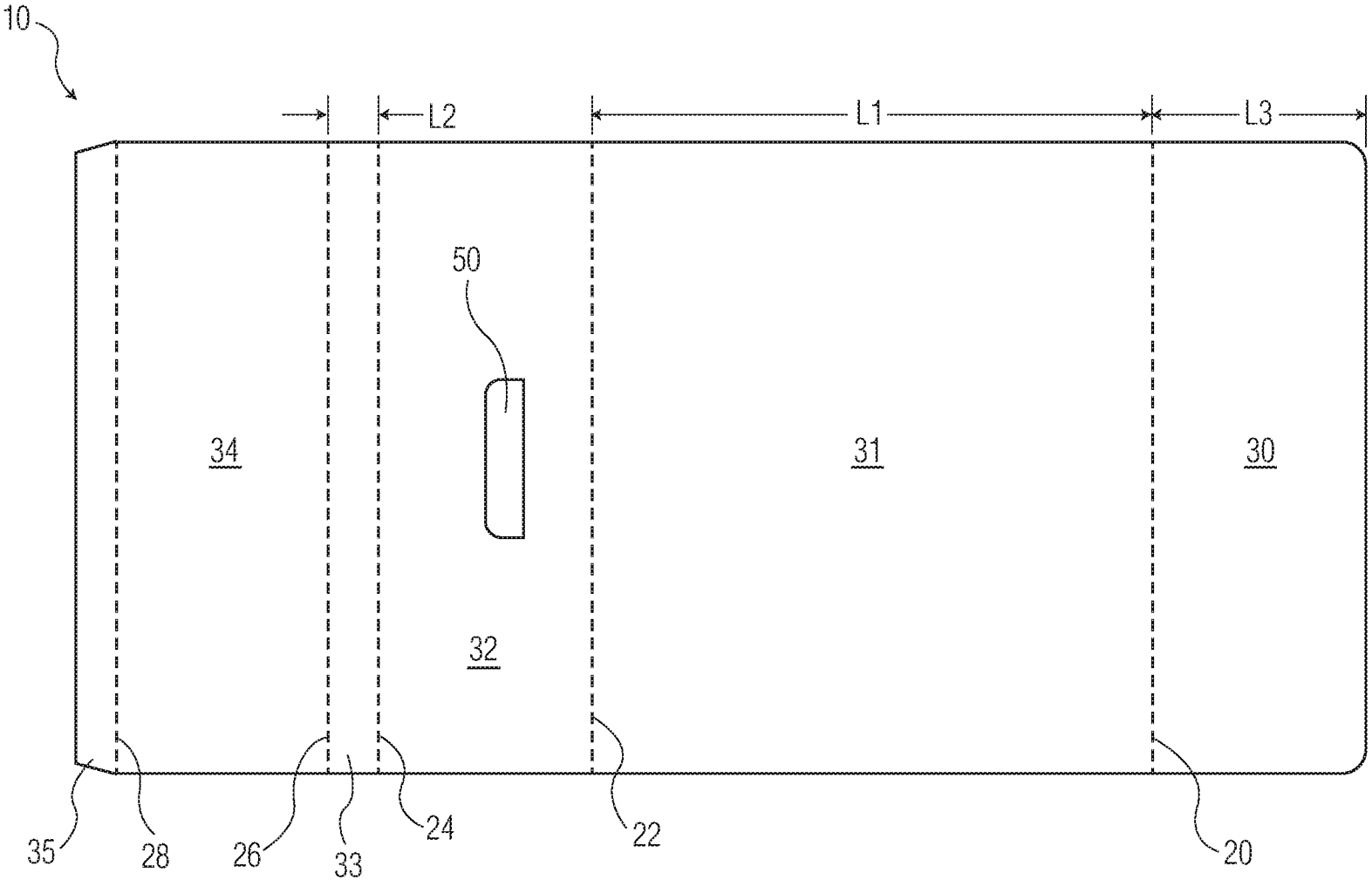
FIG. 1 is top plane view of a carton blank useful in the present invention.

The package of the present invention generally comprises a folded blank that at least partially separates the packaged goods from one another and adds stability and integrity to the package. One embodiment of a blank useful in the present invention is illustrated in FIG. 1. The blank 10 starts out as a flat sheet of paperboard, cardboard, corrugated cardboard, or the like, is cut and pre-stressed along a matrix of fold lines 20, 22, 24, 26 and 28 for folding into a three-dimensional divider useful in the package of the present invention. The blank 10 includes a first panel 30 (corresponding to the bottom panel of the folded divider), a second panel 31 (corresponding to the vertical wall panel of the folded divider), a third panel 32 (corresponding to the top panel of the folded divider), a fourth panel 33 (corresponding to the front edge panel of the folded divider), a fifth panel 34 (corresponding to the folded under panel of the folded divider) and optionally a sixth panel 35 (corresponding to a tab for securing the folded under panel to the vertical wall panel of the folded divider). It should be understood that the terms "top", "bottom", "left", "right", "front" and "back" are arbitrary designations used only to lend consistency to the description of the various orientations of elements. Generally, "left" is opposite (similar to diametrically opposed) of "right", "top" is opposite of "bottom", "front" is opposite of "rear" (or "back"), etc.

The panels 30, 31, 32, 33, 34 and 35 are generally separated from one another by fold lines 20, 22, 24, 26 and 28, which facilitate folding of the blank into a three-dimensional divider useful in the package of the present invention. As used herein, fold line encompasses any line provided on a blank for allowing the same to be folded in a predetermined fashion. Thus, fold line encompasses a preformed score line which is free from perforations, partially perforated, or fully perforated. Providing perforations along a fold line facilitates folding certain portions of the blank, particularly where the blank is formed from corrugated cardboard. Where thinner cardboard is used for the blank, preformed fold lines which are free from perforations are generally sufficient to allow folding as desired.

In certain instances the third panel 32, which generally corresponds to the top panel of the folded divider, may be provided with a cut out forming a handle 50. In other embodiments a punch-out area defined by a line of weakness, such as a line of perforations, may be provided on the third panel to form the hand grip.

The dimensions of the panels 30, 31, 32, 33, 34 and 35 may be varied depending on the size and types of products to be packaged. In a particularly preferred embodiment the length (L1) of the second panel 31 is substantially equal to the height of the tallest product to be packaged and the length (L2) of the fourth panel 33 is substantially equal to the height of the shortest product to be packaged. In certain embodiments L1 may range from about 25 to about 35 cm, such as from about 27.5 to about 32.5 cm and L2 may range from about 2 to about 8 cm, such as from about 4 to about 6 cm. Regardless, it is generally preferred that L1 is greater than L2.

In other embodiments the length (L3) of the first panel 30 is substantially equal to the width of a first packaged product, which may be the diameter of a first spirally wound tissue product, and the length (L4) of the fifth panel 34 is substantially equal to the width of a second packaged product, which may be the diameter of a second spirally wound tissue product.

To form the package of the present invention, in certain embodiments, the top panel of the divider blank is folded and a tab extending from the top panel is attached to the vertical wall panel to form a folded over portion having a cavity with a first and a second end. Next, the bottom panel is folded away from the vertical wall panel to yield a z-shaped divider having a substantially vertical wall panel, a folded over portion extending from the top end of the vertical wall panel and defining an upper wall portion and a bottom panel extending from the bottom end of the vertical wall panel in a direction generally opposite that of the folded over portion.

Figure 2:
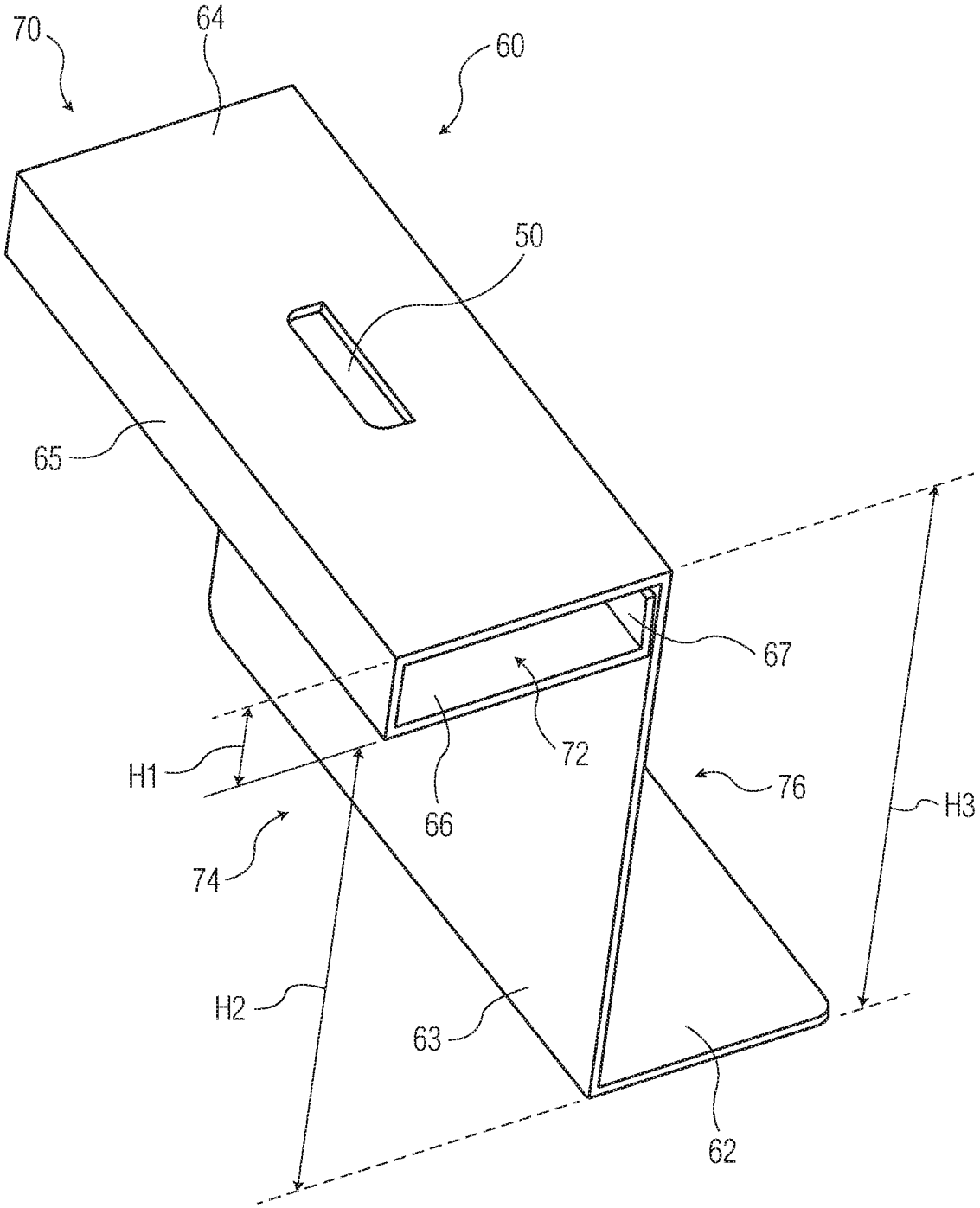
FIG. 2 is a perspective view of the blank of FIG. 1 in a folded configuration.

Now with reference to FIG. 2, the blank of FIG. 1 is shown in a folded configuration to yield a divider 60, useful in the present invention. The divider 60 may take any number of forms, but generally comprises a substantially vertical wall 63 that defines first and second, or front and back, halves that are generally shaped to receive and house a plurality of tissue products and more preferably at least two, and more preferably at least three, different tissue products. As will be discussed in more detail below the tissue products may differ from one another in regards to at least one physical attribute such as volume, height, diameter, basis weight, tensile strength, absorbency, or the like.

In the illustrated embodiment the divider 60 includes a vertical wall panel 63, a bottom panel 62 and a top panel 64 extending from the vertical wall panel 63, a front edge panel 65, a folded under panel 66 and optionally a tab 67 for securing the folded under panel 64 to the vertical wall panel 63. The divider 60 may be folded so as to form a four-sided, generally rectilinear, folded over portion 70, which defines a cavity 72 for receiving and storing a tissue product, particularly a packaged tissue product. In the illustrated embodiment, the front edge panel 65 and tab 67 form the end-walls of the folded over portion 70 while the top panel 64 and folded under panel 66 form the top and bottom walls.

As further illustrated in FIG. 2 a cut out is provided along the top panel 66 to form a handle 50. In other embodiments to make a packaged tissue product disposed in the cavity visible to the consumer the top panel or the front edge panel may include a cut out or window. In certain embodiments the window may be covered with a transparent film to provide viewing of the packaged tissue product, but to prevent damage during shipping and handling.

In a particularly preferred embodiment, such as that illustrated in FIG. 2, the folded over portion 70 lacks side-walls so as not to obscure the packaged tissue product disposed within the cavity 72. While it may be preferable to form the cavity without side-walls the invention is not so limited and in other embodiments side-walls may be provided so as to entirely envelope the tissue product disposed within the cavity. In those embodiments where the cavity lacks side-walls the tissue product may form a portion of the peripheral face of the package and be contacted by the packaging film.

With continued reference to FIG. 2, below the folded over portion 70 is a first product receiving void 74. A second product receiving void 76 is disposed on the opposite side of the vertical wall panel 63 from the first product receiving void 74. The cavity 72 may have a height (H1) that is approximately equal to the height of the packaged tissue product to be retained in the cavity. The first product receiving void 74 may have a height (H2) that is approximately equal to the height of the tissue product to be disposed therein. Similarly, the second product receiving void 76 may have a height (H3) that is approximately equal to the height of the tissue product to be disposed therein. In a certain preferred embodiment the packaged tissue product to be retained in the cavity is the shortest of the packaged together tissue products and H1 is less than H2 and H3. In a particularly preferred embodiment the sum of H1 and H2 are substantially equal to H3.

While the dimensions of the divider may vary, in certain preferred embodiments H1 is from about 2 to about 10 cm, such as from about 4 to about 8 cm, and H2 is from about 22 to about 30 cm, such as from about 24 to about 28 cm. The height H3 may range from about 25 to about 35 cm, such as from about 27.5 to about 32.5 cm and may be approximately equal to the sum of H1 and H2. For example, in one preferred embodiment, H1 may be about 5 cm, H2 may be about 27 cm and H3 may be about 32 cm.

Figure 3:
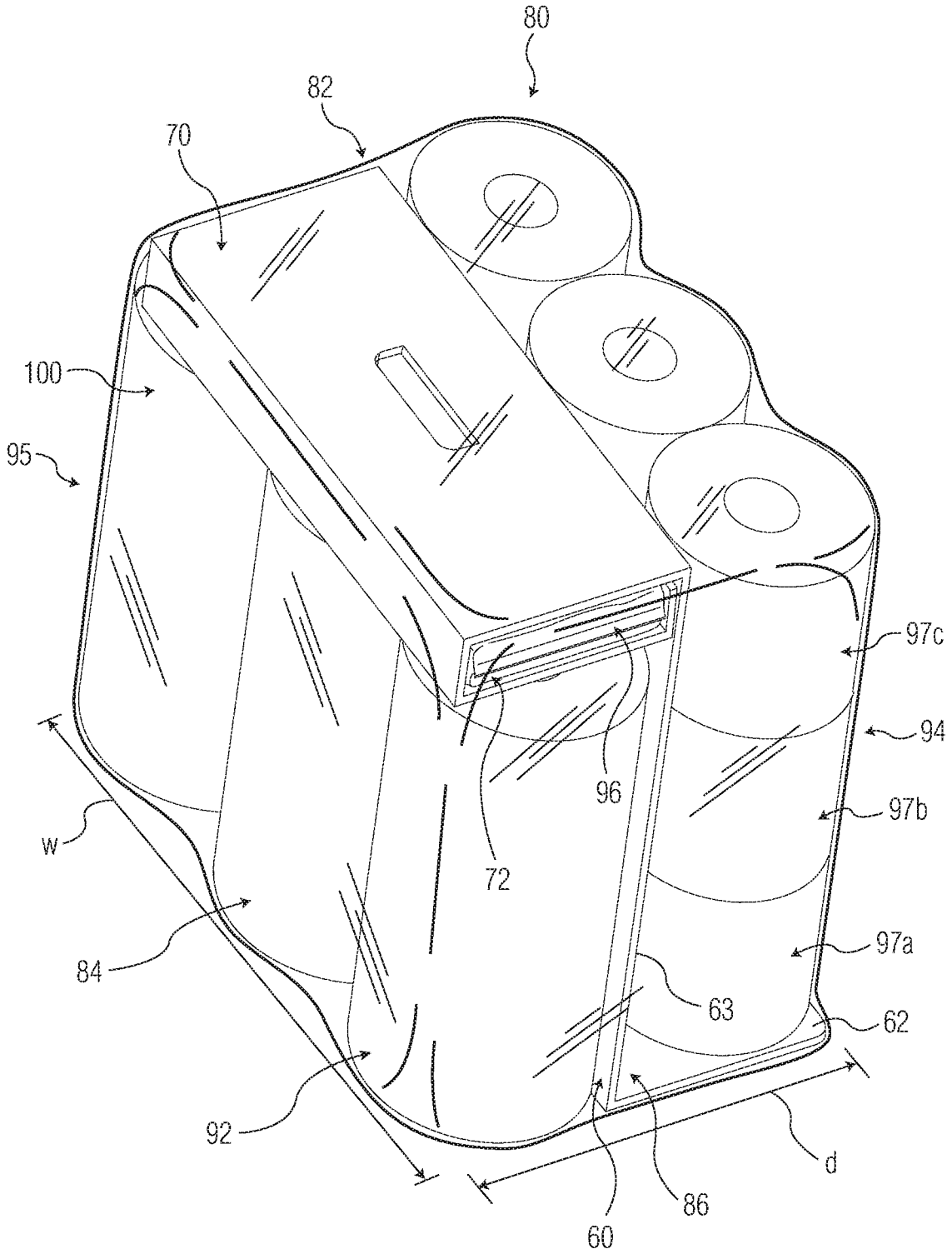
FIG. 3 is a perspective view of a package according to one embodiment the present invention.
Figure 4:
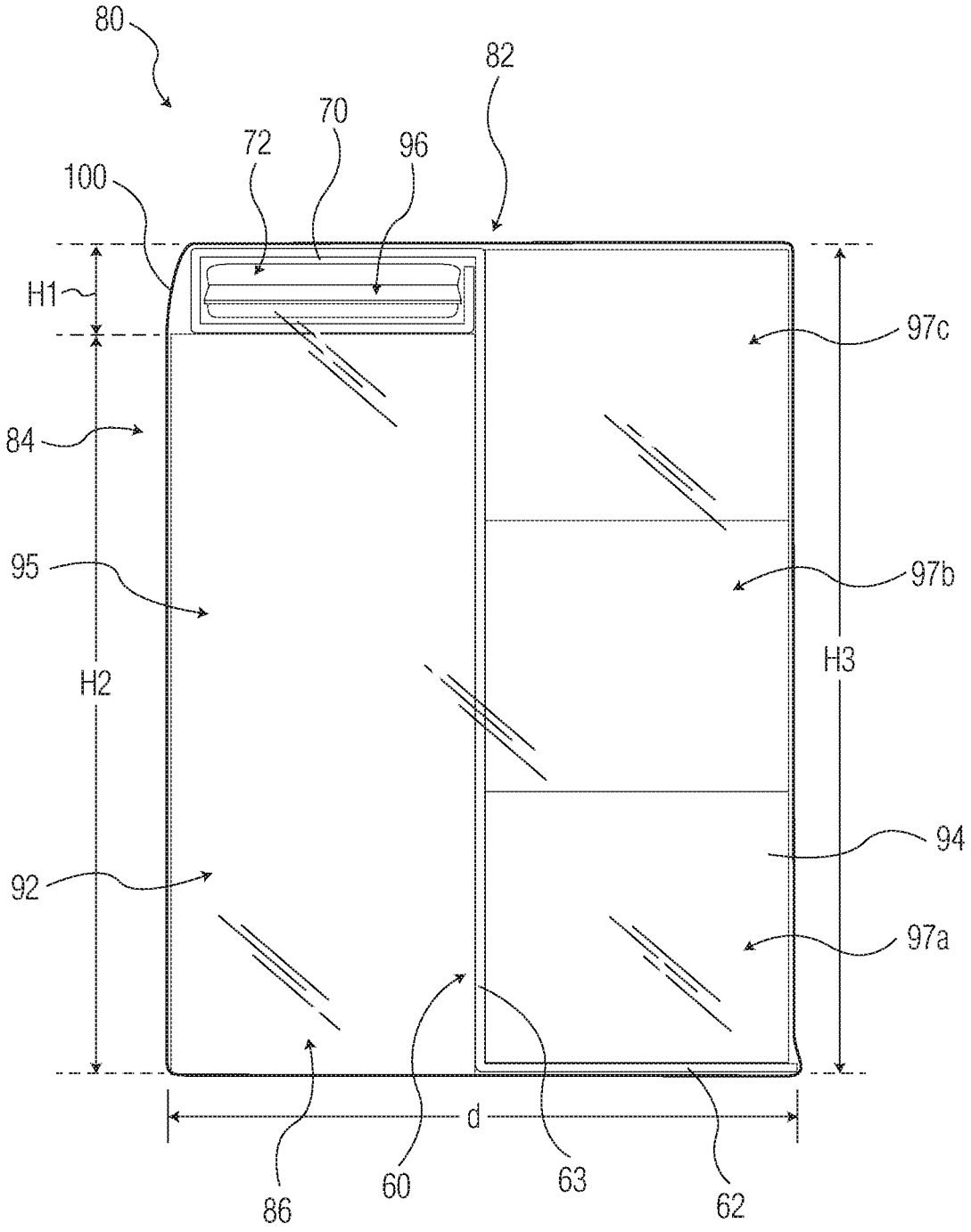
FIG. 4 is a side view of a package according to one embodiment the present invention.

Now with reference to FIGS. 3 and 4, the package 80 is represented as a single outline having a cube shape that has top 82 and bottom (not illustrated) faces, opposing back (not illustrated) and front faces 84 and opposing side-faces (first side face 86 illustrated in FIGS. 2 and 3). The package has a package width (W), a package front height and a package depth (d). Although the illustrated package has a cubic shape, the shape of the package is not limited to being a cube shape and may be of any shape defined by the respective product items being packaged together.

Front, rear and side-faces (front face 84 and side-face 86 visible in FIG. 3) each comprise a plurality of rolled tissue products 92 and 94. The front face 84 comprises first rolled tissue products 92 (three in the illustrated embodiment) arranged in a single row 95 and a second plurality of rolled tissue products 94 (nine in the illustrated embodiment) arranged in first, second and third rows 97*a*-97*c*. Further, the package comprises a third tissue product 96, which in the illustrated embodiment comprises a package of wet wipes, disposed in the cavity 72 formed by the folded over portion 70. The third tissue product 96 is disposed above the first tissue product 92 and the second tissue product 94 is disposed opposite of the first product 92 on the opposite side of the vertical divider wall 63. While the tissue products are illustrated as being arranged in a particular fashion the arrangement is not limiting and one of ordinary skill in the art will appreciate that arrangements other than those illustrated in FIGS. 2-3 are possible. For example the divider may be folded over to form a cavity that is disposed below a column of rolled tissue products and forms a portion of the package bottom. In other embodiments both the front and rear faces may comprise rolls of tissue products stacked in columns and rows, while in still other embodiments each face may comprise rolled tissue products arranged in a single row.

While various arrangements of divider and tissue products are possible, in certain preferred embodiments the package 80 comprises six faces (top 82, front 84 and side 86 faces illustrated in FIG. 3) and least a portion of the top face 82 is formed by the folded over portion 70 and the second rolled tissue product 94. The resulting package is generally cubic and has a width (W), a height, and a depth (d), and the rear face is formed from an array of second rolled tissue products 94 having multiple rows (rows 97*a*-97*c* illustrated in FIG. 3) and columns. In certain preferred embodiments the array of second rolled tissue product may comprises nine rolled tissue products and the package height is equivalent to three roll heights and the package width is equivalent to three roll diameters.

While various arrangements will be evident to those skilled in the art, it is generally preferred that rolled tissue products form at least a portion of each of the package faces. In this manner the rolled tissue products may be visible to a consumer from multiple package facings. Particularly preferred arrangements are those arrangements in which the folded over portion forms a portion of at least two different faces of the package and even more preferred are those arrangements in which the folded over portion forms a portion of at least two different faces and is contacted by rolled tissue products.

With continued reference to FIGS. 3 and 4, the rolled tissue products 92, 94, bottom panel 62 and folded over portion 70 are surrounded by a packaging film 100. Although the packaging film 100 substantially encloses the rolled tissue products 92, 94 bottom panel 62 and folded over portion 70 in the illustrated embodiment, the invention is not so limited. The film may be in the form of a band for example, so long as the rolled tissue products are contained within the packaging film in a stable manner. Accordingly, in certain embodiments a portion of the front, rear and side faces may be covered by film, but the opposing top and bottom faces could remain entirely free of packaging film or could be partially covered by the packaging film. Further, while the film may form the outer surface of the package, one skilled in the art will appreciate that the surfaces or faces of the package are defined by the contents—the rolled tissue products, packaged tissue products and/or divider.

In certain embodiments the film is a plastic film, and more preferably a thermoplastic film with the thermoplastic being either a monolayer or a laminate. Useful monolayer or laminate thermoplastic materials include polyethylenes and ethylene copolymers, polypropylenes and propylene copolymers, polyethylene terephthalates, vinyl polymers and copolymers and acrylic polymers and copolymers. The laminates include thermoplastic/paper laminates. A useful thermoplastic is a biaxially oriented polypropylene. In embodiments where the packaging film 100 material is a plastic film, it will preferably have a gram per square meter (gsm) weight of about 15 to about 75 gsm. In certain preferred embodiments the film material will generally have a thickness of about 300 to about 600 microns. In other embodiments it may be preferred that the film material be a heat shrinkable material.

While in certain embodiments the package comprises a folded over portion to enhance the stability of the package and maintain a cubic shape the invention is not so limited. For example, in some embodiments the packaged tissue product may comprise a rigid cubic dispenser containing a stack of wet wipes that does not need to be enveloped by the divider in order to form a stable, cubic package. Thus, in certain embodiments, the package may comprise a plurality of first rolled tissue products having an upper surface and a rigid container comprising a plurality of stacked sheets of tissue disposed thereon, the plurality of first rolled tissue products and container separated from a plurality of second rolled tissue products by a divider, the divider having a bottom panel which supports a plurality of second rolled tissue products. In such embodiments the plurality of first rolled tissue products and rigid container form the front face of the package and the plurality of second rolled tissue products form the rear face of the package.

In those embodiments where the package comprises a folded over portion the folded over portion may be arranged such that it forms a portion of one or more of the package's peripheral edges. For example, in the embodiment illustrated in FIGS. 3 and 4 the folded over portion 70 forms a portion of the top face 82. In a particularly preferred embodiment the folded over portion 70 extends the package width (W) and forms a portion of the top and front faces 82, 84 of the package. The position and dimension of the folded over portion, however, are not limiting. Further, the inclusion of a folded over portion in the package is not to be limiting. In certain embodiments the package may comprise first and second rolled tissue products and a packaged tissue product disposed in a rigid container that can be co-packaged with rolled tissue products without disposing the packaged tissue products in a folded over portion.

In a particularly preferred embodiment, such as that illustrated in FIG. 3, the packaged tissue products 96 and rolled tissue product 92, 94 are packaged together such that the rolled tissue products 92, 94 form at least a portion of each of the six faces of the package (top, front and first side faces 82, 84, 86 illustrated in FIG. 3). The folded over portion 70 forms at least a portion of at least one face of the package and more preferably a portion of at least two faces, such as the top and front faces 82, 84 as illustrated in FIG. 3. In a particularly preferred embodiment the top face is formed by both the folded over portion and the rolled tissue product while the bottom face is formed by rolled tissue product and the bottom panel of the divider.

With continued reference to FIGS. 3 and 4, the package 80 contains a packaged tissue product 96 disposed in the folded over portion 70. The illustrated folded over portion 70 has a front panel 65, which optionally may include an opening through which the packaged tissue product 96 is visible. In the illustrated embodiment the folded over portion 70 is positioned above a single row of rolled tissue products 92. The illustrated arrangement is such that the front panel 65 and the row of rolled tissue products 95 form the front face 84 of the package 80. The folded over portion 70 also comprises a top panel 64, which together with the upper surface of the second rolled tissue product 94 forms the package's top face 82.

The first and second rolled tissue products are preferably consumer-oriented rolled tissue products, also referred to herein as tissue rolls, which includes paper towels and bath tissue. In certain instances the package comprises a first rolled tissue product that is a spirally wound towel. Towels are well known in the art and typically have a basis weight greater than 45 grams per square meter (gsm), such as from 45 to about 80 gsm and more preferably from 45 to about 60 gsm. Basis weight may be measured according to Tappi Standard Method T-401 and generally refers to the conditioned basis weight. In other instances rolled towel products may have a geometric mean tensile strength (GMT) greater than 1,500 g/3" such as from 1,500 to about 3,000 g/3" and more preferably from 1,500 to about 2,500 g/3". Tensile strength may be measured according to Tappi Standard Method T-494. In other instances where the first rolled tissue product comprises a spirally wound towel the second rolled tissue product may comprise a spirally wound bath tissue having a basis weight less than 45 gsm, such as from about 10 to about 45 gsm, and a GMT less than 1,500 g/3", such as from about 500 to 1,500 g/3".

Each tissue roll is generally cylindrical in shape with a roll height and a roll diameter. The tissue roll has a central longitudinal axis there-through and an outer face that is generally parallel to the longitudinal axis. The tissue roll also has two opposing end faces generally perpendicular to the outer face and the longitudinal axis. An exemplary tissue roll of bath tissue has an as-packaged roll height of approximately 10 cm and an as-packaged roll diameter of approximately 10 cm. An exemplary tissue roll of paper towels has an as-packaged roll height of approximately 28 cm and an as-packaged roll diameter of 15 cm. In various aspects of the present invention, the tissue roll dimensions may be of any suitable size.

While rolled tissue products may be packaged and sold individually, the present invention relates to packaging a plurality of rolled tissue products with a package of tissue products in a single unitary package. The package may hold any suitable number of rolled tissue products. In one particular example the package includes first and second rolled tissue products where the products are different in regards to at least one physical attribute, such as having different dimensions or intrinsic physical properties. For example, in certain instances the products may differ in regards to height, diameter or volume. In other instances the products may differ in regards to basis weight, absorbency, or tensile strength (measured as geometric mean tensile strength). Preferably the package comprises a plurality of both first and second rolled tissue products and the products are arranged in an array, such as a single row of three first rolled tissue products and two rows of three second rolled tissue products.

In the as-displayed orientation illustrated in FIGS. 3 and 4, the package 80 generally has dimensions of three roll diameters wide, two roll diameters long and one first rolled tissue product high or three second rolled tissue products high. In certain preferred embodiments the height of first rolled tissue product is greater than the height of the second rolled tissue product, however, the second rolled tissue products are arranged in an array comprising multiple rows and the height of the array is greater than the height of the first rolled tissue product.

In particularly preferred embodiments the package comprises one or more rolled tissue products positioned adjacent to a folded over portion of the divider which houses a packaged tissue product. The packaged tissue product generally comprises a package, such as a carton, container or dispenser, containing a stack of individual sheets. The package may be any of the packages known in the art and may be flexible, semi-rigid or rigid. Generally, as used herein the term "stacked tissue products" refers to individual sheets of material arranged in facing relation with one another to form a stack of sheet material. The individual sheets may comprise absorbent paper, tissue, nonwoven material, or the like.

In a particularly preferred embodiment the packaged tissue product comprises a stack of pre-moistened wiping substrates disposed in a container. In certain embodiments the stack of tissue products are wet wipes, which are well known in the art. Wet wipes are typically pre-moistened with various compositions for ease in cleaning, disinfecting, and providing skin care benefits (e.g., moisturizing). Such stacks of wet wipes are typically placed within packages for shipping, storage, sale, and dispensing. As used herein, the term "wet wipe" for purposes of the present invention means a pre-moistened nonwoven web of fibers that can be used, for example, for cleansing purposes and includes items such as towelettes, wipes, e.g., baby wipes, hemorrhoid wipes, feminine hygiene wipes, bedridden patient wipes, bathroom cleaning wipes, and the like, and pre-moistened toilet paper.

The stack of wipes may be disposed in a dispensing carton, as is well known in the art. The carton typically includes an opening feature, which may be located at the top side or bottom side of the package. In some embodiments, the opening feature may intercept the top side and one of the other sidewalls of the package, so that the wet wipes may be dispensed in either a pop-up manner or a reach-in manner. In some embodiments, the opening feature may include a re-sealable feature, such as a lid or an adhesive flap. The lid may have a hinge (not shown) that allows for opening and closing of the lid.

Dispensing cartons for wet wipes are well known in the art and may be incorporated in the present invention. For example, in certain embodiments the packaged tissue product may be similar to that disclosed in U.S. Pat. No. 7,303,092 and include an outer carton having an opening in which an interior tub having a baffle and an aperture located in the baffle is disposed. A rigid flip top is disposed over the carton opening for access to the interior tub and a plurality of wet wipes is disposed within the interior tub beneath the baffle. In other embodiments the packaged tissue product may comprise a carton comprising a pop-up style dispensing means formed by a rigid port which surrounds a flexible, rubber-like material or sheet having one or more slits through which the wet wipes are dispensed, such as that disclosed in U.S. Pat. No. 6,523,690.

In other embodiments the packaged tissue product may comprise a stack of dry tissue sheets disposed in a carton including, for example, those described in U.S. Pat. Nos. 2,573,309, 3,239,097, 3,369,699, 4,863,064 and US Publication No. 2005/0011906. In such embodiments the packaged tissue product comprises a dispenser (also referred to as a carton) containing a plurality of individual tissue sheets that are dispensed through an opening. In this embodiment, the individual tissue sheets are prefolded or otherwise bunched/gathered together to further assist a child during toilet training. In this manner, the tissue sheets emerge from the dispenser in a condition ready for wiping. The carton may be rigid or semi-rigid and be constructed from folded paperboard, or the like, or it may be flexible and be constructed from a polymeric film.

As noted previously, in certain embodiments the overall stability of the package may be increased by providing a divider, a portion of which is folded over and houses a packaged tissue product. The divider further provides spaces to receive other tissue products, such as rolled tissue products, which may be packed on either side of the divider and overwrapped with a packaging film to form the unitary package. In certain embodiments the film overwrap may be provided with a line of weakness, such as a perforation, to facilitate opening of the package. For example, in certain embodiments the front face of the packaging film may include a first perforated line. In a particularly preferred embodiment the line of weakness is formed along the upper portion of the front face and extends across both the rolled tissue products and the packaged tissue product.

Product information indicating type and the like of package contents may be provided on any of the package faces, although in certain embodiments it may be particularly preferred to provide product information on the front and opposing side faces. In certain preferred embodiments at least a portion of the package is translucent such that at least a portion of the rolled tissue products and packaged tissue products are visible through the packaging film.

While the invention has been described in detail in the foregoing description, those skilled in the art will appreciate that the present invention may be embodied in any one of several different embodiments including, for example:

In a first embodiment the present invention provides a package of tissue products comprising a divider having a substantially vertical wall panel dividing the package into a first side and an opposite second side, and a folded over portion defining a cavity extending therefrom, a packaged tissue product disposed in the cavity, a first rolled tissue product disposed on the first side and below the folded over portion and a second rolled tissue product disposed on the second side.

In a second embodiment the present invention provides the package of the first embodiment wherein the divider further comprises a bottom wall panel extending from the vertical wall panel. In other embodiments the folded over portion extends in a first direction and the bottom wall panel extends in a second direction opposite of the folded over portion and the divider is generally z-shaped.

In a third embodiment the present invention provides the package of the first or the second embodiments comprising a plurality of first rolled tissue products and a plurality of second rolled tissue products, the first rolled tissue products arranged in an array comprising a single row of products and the second rolled tissue products arranged in an array comprising three rows of products.

In a fourth embodiment the present invention provides the package of any one of the first through third embodiments comprising a plurality of first rolled tissue products and a plurality of second rolled tissue products wherein the first and second plurality of products have at least one physical attribute selected from the group consisting of basis weight, absorbency, or tensile strength that is different.

In a fifth embodiment the present invention provides the package of any one of the first through fourth embodiments comprising a plurality of first rolled tissue products and a plurality of second rolled tissue products wherein the first and second plurality of products have different heights and diameters.

In a sixth embodiment the present invention provides the package of any one of the first through fifth embodiments comprising a plurality of first rolled tissue products and a plurality of second rolled tissue products wherein the first plurality of products comprise spirally wound towels having a basis weight greater than 45 grams per square meter (gsm) and a geometric mean tensile (GMT) strength greater than 1,500 g/3" and the second plurality of products comprise spirally wound bath tissue having a basis weight less than 45 gsm and a GMT less than 1,500 g/3".

In a seventh embodiment the present invention provides the package of any one of the first through sixth embodiments wherein the folded over portion comprises a top panel, a front edge panel, a folded under panel and a tab. In other embodiments the package may further comprise a cut out defining a handle disposed on the top panel.

In an eighth embodiment the present invention provides the package of any one of the first through seventh embodiments further comprising a film at least partially overwrapping the first and the second rolled tissue products.

In a ninth embodiment the present invention provides the package of any one of the first through eighth embodiments wherein the packaged tissue product comprises a carton, a lid and a plurality of pre-moistened wipes stacked in facing arrangement with one another disposed in the carton.

In a tenth embodiment the present invention provides the package of any one of the first through ninth embodiments wherein the packaged tissue product comprises a carton, a lid and a plurality of pre-moistened wipes stacked in facing arrangement with one another disposed in the carton.

What is claimed is:

1. A package of tissue products comprising a divider having a substantially vertical wall panel dividing the package into a first side and an opposite second side, and a folded over portion comprising a top panel, a front edge panel, a folded under panel and a tab, the folded over portion defining a cavity extending therefrom, a packaged tissue product disposed in the cavity, a first rolled tissue product disposed on the first side and below the folded over portion and a second rolled tissue product disposed on the second side.

2. The package of claim 1 wherein the divider further comprises a bottom wall panel extending from the vertical wall panel.

3. The package of claim 2 wherein the folded over portion extends in a first direction and the bottom wall panel extends in a second direction opposite of the folded over portion and the divider is generally z-shaped.

4. The package of claim 3 wherein the first rolled tissue product is disposed below the folded over portion and the second rolled tissue product is disposed above the bottom wall panel.

5. The package of claim 1 comprising a plurality of first rolled tissue products and a plurality of second rolled tissue products, the first rolled tissue products arranged in an array comprising a single row of products and the second rolled tissue products arranged in an array comprising three rows of products.

6. The package of claim 1 comprising a plurality of first rolled tissue products and a plurality of second rolled tissue products wherein the first and second plurality of products have at least one physical attribute selected from the group consisting of basis weight, absorbency, or tensile strength that is different.

7. The package of claim 1 comprising a plurality of first rolled tissue products and a plurality of second rolled tissue products wherein the first and second plurality of products have different heights and diameters.

8. The package of claim 1 comprising a plurality of first rolled tissue products and a plurality of second rolled tissue products wherein the first plurality of products comprises spirally wound towels having a basis weight greater than 45 grams per square meter (gsm) and a geometric mean tensile (GMT) strength greater than 1,500 g/3" and the second plurality of products comprises spirally wound bath tissue having a basis weight less than 45 gsm and a GMT less than 1,500 g/3".

9. The package of claim 1 further comprising a cut out defining a handle disposed on the top panel.

10. The package of claim 1 wherein the package is substantially cubic.

11. The package of claim 1 further comprising a film at least partially overwrapping the first and the second rolled tissue products.

12. The package of claim 1 wherein the packaged tissue product comprises a carton, a lid and a plurality of pre-moistened wipes stacked in facing arrangement with one another disposed in the carton.

13. A package of tissue products comprising a z-shaped divider having a substantially vertical wall panel and a folded over portion comprising a top panel, a front edge panel, a folded under panel and a tab, the folded over portion defining a cavity extending therefrom, a first packaged tissue product disposed in the cavity, the first packaged tissue product having a first height, a first array of rolled tissue products having a second height and a second array of rolled tissue products having a third height, wherein the sum of the first and second heights is approximately equal to the third height.

14. The package of claim 13 wherein the package has a top face, a bottom face, a first side face, a second side face, a front face and a back face, and wherein at least a portion of the top face is formed by the folded over portion and the second rolled tissue product.

15. The package of claim 13 wherein the package includes a width, a height, and a depth, and wherein the second array of rolled tissue products comprises nine rolled tissue products and the package height is equivalent to three roll heights and the package width is equivalent to three roll diameters.

16. The package of claim 13 wherein the first packaged tissue product comprises a carton, a lid and a plurality of pre-moistened wipes stacked in facing arrangement with one another disposed in the carton.

* * * * *